United States Patent [19]

Keil

[11] 4,418,032

[45] Nov. 29, 1983

[54] PROCESS FOR DRAWING TOWS OF FILAMENTS IN WATER

[75] Inventor: Erich H. Keil, Untermeitingen, Fed. Rep. of Germany

[73] Assignee: Hoechst Aktiengesellschaft, Fed. Rep. of Germany

[21] Appl. No.: 322,730

[22] Filed: Nov. 19, 1981

[30] Foreign Application Priority Data

Nov. 24, 1980 [DE] Fed. Rep. of Germany ..... 3044073

[51] Int. Cl.[3] ..... B29C 17/02

[52] U.S. Cl. ..... 264/289.6; 264/290.5; 264/DIG. 28

[58] Field of Search ..... 264/235.6, 289.6, 290.5, 264/237, DIG. 28

[56] References Cited

U.S. PATENT DOCUMENTS

| | | | |
|---|---|---|---|
| 2,918,346 | 12/1959 | Paulsen | 264/289.6 |
| 3,894,135 | 7/1975 | Riggert et al. | 264/290.5 |

FOREIGN PATENT DOCUMENTS

| | | | |
|---|---|---|---|
| 47-9226 | 3/1972 | Japan | 264/290.5 |
| 47-14055 | 4/1972 | Japan | 264/289.6 |
| 326261 | 3/1972 | U.S.S.R. | 264/290.5 |

*Primary Examiner*—James B. Lowe

*Attorney, Agent, or Firm*—Connolly and Hutz

[57] ABSTRACT

Polyesters are drawn in the form of thick tows in a predrawing and a main drawing step. Predrawing is carried out at 71°–90° C. in water, and the predraw ratio is chosen in such a manner that the main drawing can be carried out at a minimum of draw tension. Between predrawing and main drawing, the tows cool to below 40° C. Suitable draw ratios for the predrawing are from 1:1.05 to 1:1.6. The main drawing is carried out either in steam or hot water.

FIG. 2 shows the curve of draw tension in the main drawing step as function of the draw ratio in the predrawing: there is a distinct minimum.

6 Claims, 5 Drawing Figures

PROCESS FOR DRAWING TOWS OF FILAMENTS IN WATER

The invention provides a process for drawing tows of filaments made from polyesters, which comprises a predrawing step.

When drawing synthetic filaments, care has to be taken that all filaments are uniformly drawn among one another and over the length of each individual filament as well, because divergences in drawing become manifest on dyeing in the form of differently colored spots or sections. This requirement is especially difficult to meet in the drawing of so-called tows of filaments, that is, groups of many thousands of filaments, which later on are processed to staple fibers. Especially uniformly drawn fibers which therefore can be dyed even are provided by the process of German Auslegeschrift No. 1,193,198, according to which polyester tows of constant length are preheated between the feed rollers in a water bath having a temperature of 40° to 70° C., then, while maintaining the temperature, conveyed to a second bath having a temperature of 60° to 100° C. and drawn therein, the temperature of the second bath being maintained at 10° C. at least above that of the first bath.

A similar process for preheating tows of polyester filaments is known from German Auslegeschrift No. 2,149,793, according to which the tows are passed by the motion of the penultimate roller of the feed roller system through a dipping bath having a temperature of 40° to 65° C. in order to uniformly and thoroughly warming the tow. According to this paper, too, the tow is maintained at elevated temperature from the water bath on to the drawing operation.

However, the tows of filaments obtained according to this state of the art or the staple fibers manufactured therefrom do not meet all requirements especially with respect to even dyeing.

It is therefore the object of the invention to improve further the uniformity in the drawing of tows of filaments in order to reduce considerably the number of dyeing flaws. However, the ratio, the temperature and the medium of drawing are to remain free to choose.

This object is achieved by the process of the invention, which comprises carrying out the predrawing in water having a temperature of from 71° to 90° C., choosing the draw ratio in the predrawing in such a manner that the main drawing is carried out at minimal draw tension, and cooling the fiber tows to a temperature of below 40° C. between the predrawing and the main drawing steps.

Preferably, the draw ratio is from 1:1.05 to 1:1.6 in the predrawing zone; especially, it is below 1:1.4, and particularly in a range of from 1:1.1 to 1:1.3.

BRIEF DESCRIPTION OF THE DRAWING

FIG. 2A shows the draw tension in the main drawing zone of the draw ratio in the predrawing zone, at constant total draw ratio, and as a function of the main drawing ratio (GV/VV).

FIG. 3 shows the number of rhodamine incidents (dyeing flaws) per 20 g of fibers as a function of the draw ratio in the predrawing zone.

FIG. 4 shows the number of dyeing flaws per 20 g of fibers (rhodamine incidents) as a function of the temperature of the predrawing bath.

Figure 1:
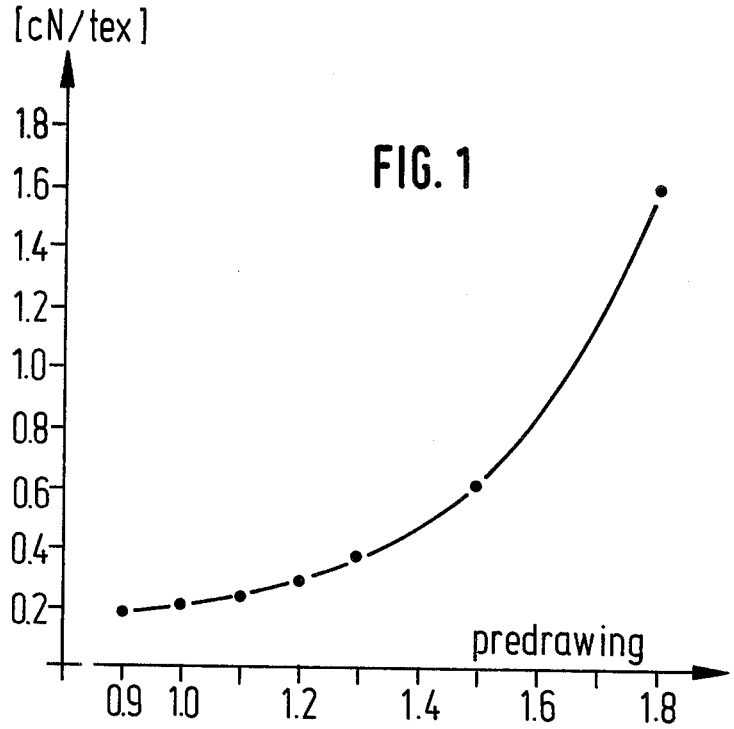
FIG. 1 is a graphical plot showing the increase of draw tension in the predrawing zone as a function of the predrawing ratio.

The tows of filaments are continuous structures consisting of a multitude of filaments, which are formed by combining the filaments of several spinnerets. They have a titer of up to 1,000,000 dtex or even more. After a common treatment of all filaments, they are normally cut to give staple fibers, which for their part are processed to staple fiber yarns.

The tows of filaments treated according to the process of the invention are made from polyesters, that is, linear high polymers and at least 85% of repeated moieties of terephthalic acid and a diol. The remaining 15% of repeated moieties of the polymer may be formed by comonomers of the dicarboxylic acid component or the glycol component.

The predrawing is an orientating one, that is, it is accompanied by an increase of birefringence, but a draw point is not attained as yet. By draw point, there is to be understood the sudden and clearly visible alteration of diameter ("bottleneck") of polyester filaments of low orientation on drawing. Increase of birefringence of the goods occurs at a predraw ratio of 1:1.05.

In accordance with the invention, the predrawing is carried out in water. By water, there is to be understood pure water, but aqueous solutions or emulsions of, for example, the usual textile auxiliaries, conditioning agents or preparations as well.

According to the invention, the water has a temperature of from 71° to 90° C. When these limits are exceeded, the number of dyeing flaws increases considerably.

Surprisingly, it has been observed that predrawing in steam does not result in reducing the draw tension in the main drawing zone to a minimum which is the characteristic of the invention. Although a two-step drawing in steam reduces the dyeing flaws considerably, the result of 100 dyeing flaws per 20 g of fibers corresponds to the state of the art only.

Predrawing in water having a temperature of 71° to 90° C. is carried out at a draw ratio which ensures that the draw tension required in the main drawing attains a minimum, that is, at a draw ratio of from 1:1.05 to 1:1.6. When this range is exceeded in the predrawing zone, the properties of uniform dyeability are deteriorated.

The main drawing is carried out as usual, that is, for example, in steam or hot water. Best results are obtained when carrying out the main drawing likewise in hot water. This main drawing, too, is an orientating one, but contrary to the predrawing, draw point formation is involved.

The main drawing may be carried out also in two steps or by followed by the diverse setting processes; the advantage of the process of the invention remains intact in any case.

In accordance with the invention, the predrawing is carried out in such a manner that the draw tension required in the main drawing is at its minimum. This minimum is determined by varying the predraw ratio. The draw tension is the quotient of the force applied on the tow necessary for drawing (which can be measured by means of a corresponding commercial test apparatus, for example of Messrs. Schmidt, Waldkraiburg, West Germany) and the final titer of the drawn tow of filaments. The final titer results as the product of the titer of the as-spun filaments and the total draw ratio.

Best results are obtained by carrying out the predrawing in such a manner that the draw tension in the main drawing is really at its minimum. On the other hand, this minimum can be exceeded by up to 10% without risking the number of dyeing flaws to become inacceptable.

It is furthermore important in accordance with the invention to cool the fiber tows to below 40° C. between the predrawing and the main drawing steps, although active, additional cooling is not absolutely required. The tow may be passed simply around unheated rollers. Since in the case of tows of filaments several rollers, for example roller septets, are always used because of the heavy forces occurring, the tows of filaments are cooled automatically to about room temperature while passing over the rollers if these latter ones are not heated. However, it is advantageous to cool the rollers by means of water.

When the tows of filaments are not allowed to cool after the predrawing at 71°-90° C., the evenness of dyeing is considerably reduced, as demonstrated in Example 3.

The number of dyeing flaws is determined by dyeing with rhodamine in the following manner: 3.5 g of the dyestuff Basic Violet 10 (Color Index No. 45 170, revised third edition 1975; ®Rhodamin B of BASF AG) are dissolved at room temperature in 5 liters of distilled water; an emulsion of 30 ml of o-cresol (=carrier) and 10 ml of alkylaryl-polyglycol ether sulfate (=emulsifier, ®Hostapal BV of HOECHST AG) are then added and the batch is well mixed.

Thereafter, 1 l of this dyeing liquor is heated to boiling in a 2 liter beaker, and 1 m of the crimped tow to be examined is introduced for 3 minutes into the boiling liquor.

Subsequently, the tow section so dyed is rinsed in running tap water until the water is not colored any more. It is then washed for at least 15 minutes with frequent agitation in a solution of 0.5 g/l of an alkylaryl-polyglycol ether (emulsifier ®Hostapal CV of HOECHST AG) having a temperature of about 75°-80° C., and rinsed again in running tap water until no foam can be detected any more.

After dipping of the tow in distilled water, it is centrifuged well and dried in air for a short time.

Undrawn filaments or tacky spots of rhodamine dyed tows are counted in a dark room under UV light where undrawn filaments shine in a light to dark red color.

Extensive measuring and tests have proved that the majority of commercial fibers made from polyethylene terephthalate have from 100 to 1,000 dyeing flaws per 20 g of fibers. The predrawing according to the invention allows to reduce the number of dyeing flaws to 5 to 50 per 20 g of fibers, while the process is maintained unchanged in all other respects.

The following examples illustrate the invention.

EXAMPLE 1

A polyethylene terephthalate tow of filaments consisting of 446,080 filaments, the individual titer of the drawn fiber having 1.7 dtex, was drawn in two steps between roller septets. The width of the fiber tow was about 30 cm.

The first septet was run at room temperature and a circumferential speed of 43 m/min. A water bath having a temperature of 79° C. and a length of 3.20 m was arranged between the first and the second roller septet. The temperature of the individual rollers of the second septet was 14° C., and the speed thereof is listed in Table 1. The predraw ratio VV results from the speeds of the first and the second septet. Coming from the second septet, the tow was passed through a second drawing bath having a temperature of 79° C. and a length of 3.60 m, and then forwarded to a third septet running at a circumferential speed of 118 m/min and a temperature of 185° C. of the individual rollers. Thus, a total draw ratio GV of 2.7 resulted. There was a subsequent fourth septet the rollers of which had a temperature of 140° C. and a circumferential speed of 116 m/min.

In Table 1, there are furthermore listed the properties of the fibers obtained, the draw tension values measured in the predrawing VV and the main drawing HV, and the number of dyeing flaws per 20 g of staple fibers.

TABLE 1

| 2nd. Septet | | Textile-technological fiber data | | | | | | | |
|---|---|---|---|---|---|---|---|---|---|
| | | Bire-Fringence | Titer | Tensile strength | Elongation at break | Heat shrinkage | Draw tension | | Dyeing flaws |
| m/min | VV | $10^{-3}$ | dtex | cN/tex | % | 200° C. | VV cN/tex | HV | n/20 g |
| 43.0 | 1.0 | 12.4 | 1.60 | 51.0 | 30 | 10.1 | 0.21 | 15.0 | 35 |
| 45.2 | 1.05 | 15.8 | 1.59 | 50.5 | 32 | 10.2 | 0.21 | 14.5 | 13 |
| 47.3 | 1.1 | 16.1 | 1.58 | 50.2 | 32 | 10.0 | 0.24 | 14.0 | 10 |
| 51.6 | 1.2 | 21.0 | 1.57 | 51.1 | 33 | 9.3 | 0.30 | 13.5 | 8 |
| 55.9 | 1.3 | 23.1 | 1.59 | 50.3 | 32 | 8.3 | 0.38 | 14.0 | 10 |
| 64.5 | 1.5 | 47.6 | 1.62 | 50.1 | 30 | 8.5 | 0.62 | 18.0 | 17 |
| 68.8 | 1.6 | 60.0 | 1.61 | 50.8 | 32 | 8.7 | 0.82 | 21.0 | 25 |

Spinning goods 15.1

The samples for measuring the birefringence were removed after the second roller of the second septet.

Table 1 demonstrates how the minimum of draw tension in the main drawing results in the minimum number of dyeing flaws per 20 g of fibers.

Figure 2:
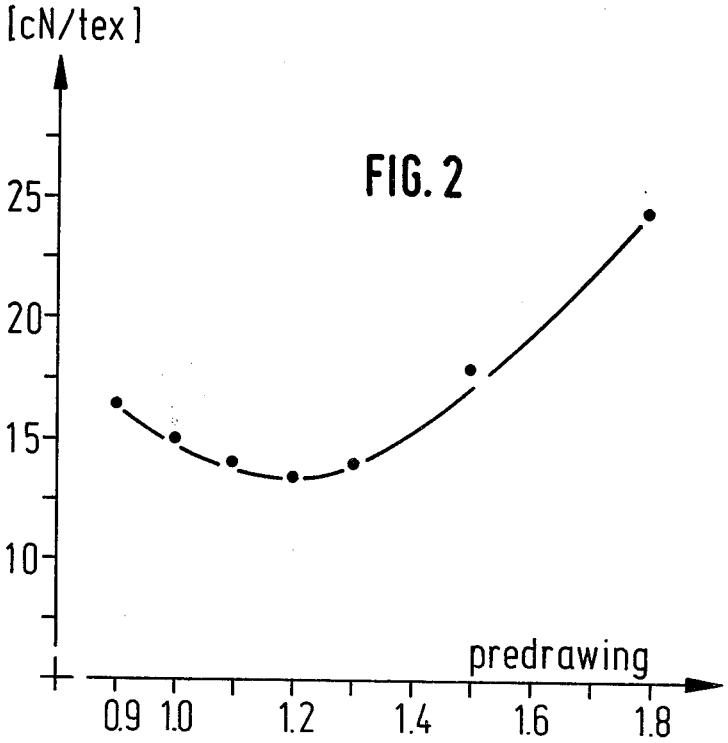
FIG. 2 is a graphical plot showing the draw tension in the main drawing zone as a function of the draw ratio in the predrawing zone (i.e. the predrawing ratio), at constant total draw ratio.
Figure 2A:
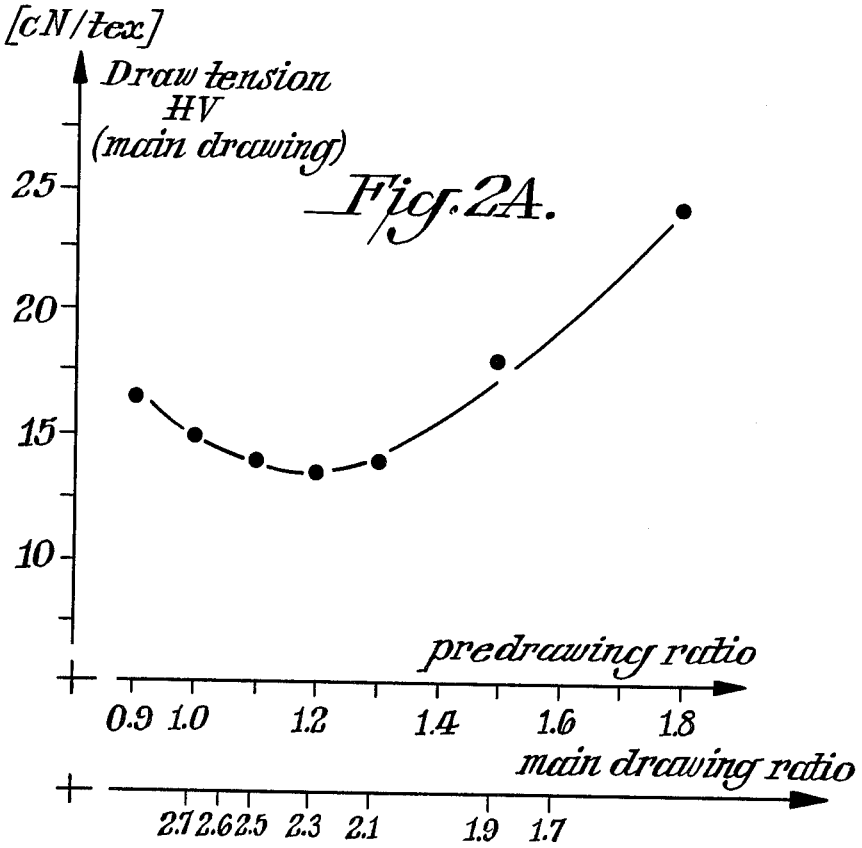
FIGS. 2A 3 and 4 are also graphic plots.

FIG. 1 of the accompanying graphs shows the steady increase of draw tension in the predrawing zone VV at increasing predrawing. This is not surprising. The more surprising, however, is the curve of FIG. 2 showing the draw tension in the main drawing zone as function of the draw ratio in the predrawing zone—at constant total draw ratio.

Figure 3:
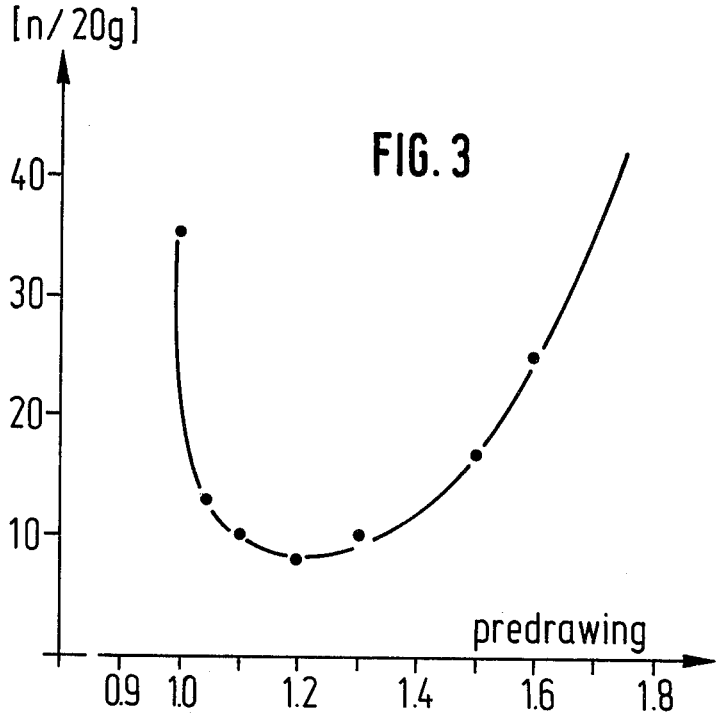

Likewise surprising is the minimum of rhodamine incidents (dyeing flaws) depending on the draw ratio in the predrawing zone, which is illustrated in FIG. 3. This minimum is at the same place as the minimum of draw tension in the main drawing zone (FIG. 2).

Figure 4:
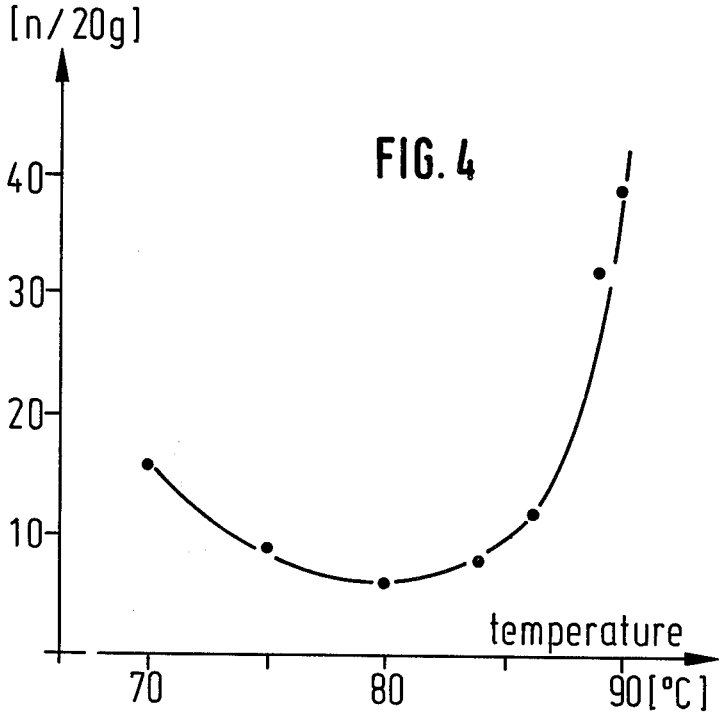

FIG. 4 demonstrates the pronounced dependence of dyeing flaws n/20 g (rhodamine incidents) on the temperature of the predrawing bath. This curve proves that the temperature of the predrawing bath must be between 71° and 90° C. when polyethylene terephthalate tows are processed (see Example 2).

EXAMPLE 2

Example 1 was repeated at a constant speed of the second septet of 51.6 m/min, that is, a draw ratio of 1:1.2, which had proved to be the ideal one according to Example 1. In this case, however, the temperature of the first bath was varied.

The results are listed in Table 2.

TABLE 2

| 1st bath °C. | Titer dtex | Strength cN/tex | Elongation % | Heat shrinkage % | Rhodamine incidents n/20 g |
|---|---|---|---|---|---|
| 70 | — | — | — | — | 16 |
| 74 | 1.55 | 52.8 | 23 | 10.5 | 9 |
| 80 | 1.61 | 51.2 | 26 | 9.4 | 6 |
| 84 | — | — | — | — | 8 |
| 86 | 1.60 | 48.2 | 32 | 10.8 | 12 |
| 89 | 1.63 | 44.0 | 43 | 10.0 | 32 |
| 90 | — | — | — | — | 39 |

It can be taken from Table 2 that the number of rhodamine incidents (dyeing flaws) first drops with rising water temperature until 80° C., then, however, rises with the water temperature rising further. FIG. 4 is a diagrammatical view of this phenomenon.

EXAMPLE 3

A polyethylene terephthalate tow having a total drawing titer of 800,000 dtex and an individual titer of 1.7 dtex was drawn at a rate of 26,000 dtex/cm on the rollers. The first septet was run at room temperature and a circumferential speed of 48 m/min. The first water bath had a temperature of 80° C. The rollers of the second septet had a circumferential speed of 57.6 m/min each, which gives a predraw ratio of 1:1.2. The temperature of the rollers was varied. The second water bath had a temperature of 80° C., the temperature of the third septet was 179° C., and that of the fourth septet was 135° C.

Further data are listed in Table 3.

TABLE 3

| 2nd septet temp. °C. | 3rd septet m/min | Total draw ratio GV | 4th septet m/min | Titer dtex | Tensile strength cN/tex | Elongation at break % | Shrinkage % | Dyeing flaws n/20 g |
|---|---|---|---|---|---|---|---|---|
| 14 | 132 | 2.75 | 129.6 | 1.61 | 55.2 | 23.4 | 9.8 | 9 |
| 70 | 127.2 | 2.65 | 124.8 | 1.74 | 50.2 | 28.4 | 9.6 | 74 |
| 80 | 127.2 | 2.65 | 124.8 | 1.72 | 49.7 | 26.1 | 8.1 | 91 |

At a roller temperature of 14° C., the temperature of the fiber tow dropped from 70° C. when entering the second septet to 28° C. on the 6th roller.

Table 3 shows that under essentially constant drawing conditions the number of dyeing flaws increases considerably when the tow of filaments is not allowed to cool before reaching the second water bath but is maintained at 70° or 80° C. by means of heated rollers. In this operation mode the total draw ratio even had to be reduced, because a multitude of torn filaments caused lap formation at the third septet.

What is claimed is:

1. A process including a predrawing and a main drawing stage for drawing a fiber tow made from polyester fibers, said process comprising:

predrawing the fiber tow in water having a temperature of from 71° to 90° C. at a predrawing ratio which (a) orients the fibers in the fiber tow without attaining the draw point and (b) substantially minimizes the draw tension needed for orientation and draw point attainment in a subsequent main drawing stage;

cooling the fiber tow to a temperature below 40° C. after the predrawing and before the main drawing stage;

subsequently drawing the fiber tow in a main drawing stage at a main drawing ratio corresponding to a drawing tension which is not more than about 10% greater than the minimum drawing tension for orienting the fibers in the fiber tow and providing draw point formation;

whereas, for a given total draw ratio, the predrawing ratio is selected so as to permit the selection of a main drawing ratio corresponding to the said drawing tension, thereby not exceeding about 10% above the minimum drawing tension and nevertheless providing draw point formation.

2. A process according to claim 1 wherein the predrawing ratio is at least 1.05 but less than about 1.6.

3. The process as claimed in claim 1, wherein the draw ratio in the predrawing zone is below 1:1.4.

4. The process as claimed in claim 1, wherein the draw ratio in the predrawing zone is from 1:1.1 to 1:1.3.

5. The process as claimed in claim 1, which comprises carrying out the main drawing in steam.

6. The process as claimed in claim 1, which comprises carrying out the main drawing in hot water.

* * * * *